US010918916B2

(12) United States Patent
Jertson et al.

(10) Patent No.: US 10,918,916 B2
(45) **Date of Patent: *Feb. 16, 2021**

(54) GOLF CLUB HEAD HAVING SURFACE FEATURES THAT INFLUENCE GOLF BALL SPIN

(71) Applicant: KARSTEN MANUFACTURING CORPORATION, Phoenix, AZ (US)

(72) Inventors: Martin Jertson, Cave Creek, AZ (US); Ryan Stokke, Anthem, AZ (US); Evan Greer, Phoenix, AZ (US); Calvin Wang, Chandler, AZ (US); Erik Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/253,495

(22) Filed: Jan. 22, 2019

(65) Prior Publication Data

US 2019/0151720 A1 May 23, 2019

Related U.S. Application Data

(63) Continuation of application No. 15/262,904, filed on Sep. 12, 2016, now Pat. No. 10,232,231.

(60) Provisional application No. 62/217,276, filed on Sep. 11, 2015, provisional application No. 62/274,832, (Continued)

(51) Int. Cl.
*A63B 53/04* (2015.01)

(52) U.S. Cl.
CPC ..... *A63B 53/0466* (2013.01); *A63B 53/0408* (2020.08); *A63B 53/0445* (2020.08)

(58) Field of Classification Search
CPC ..... A63B 53/0466; A63B 53/0408; A63B 53/0445
See application file for complete search history.

(56) References Cited

U.S. PATENT DOCUMENTS 5,688,186 A 11/1997 Michaels et al.
5,709,617 A * 1/1998 Nishimura ..... A63B 53/0466 473/330
5,785,610 A 7/1998 Birmingham
(Continued)

FOREIGN PATENT DOCUMENTS

CN 203408446 1/2014
GB 2481884 1/2012
(Continued)

OTHER PUBLICATIONS

PCT International Search Report and Written Opinion dated Dec. 20, 2016 from corresponding PCT Application No. PCT/US2016/051305 filed Sep. 11, 2015.
(Continued)

*Primary Examiner* — Michael D Dennis

(57) ABSTRACT

A golf club head includes a body having a crown opposite a sole, a toe end opposite a heel end, a back end, and a hosel. The golf club head also includes a club face having a loft below a loft threshold in which increasing a coefficient of friction between a golf ball and the club face decreases the spin imparted on the golf ball after impact with the club face. A surface feature positioned on a portion of the club face is configured to increase the coefficient of friction between the golf ball and the club face.

16 Claims, 6 Drawing Sheets

Related U.S. Application Data filed on Jan. 5, 2016, provisional application No. 62/291,241, filed on Feb. 4, 2016.

(56) References Cited

U.S. PATENT DOCUMENTS

| | | | | |
|---|---|---|---|---|
| D425,159 | S | 5/2000 | Helmstetter et al. | |
| 6,309,310 | B1 * | 10/2001 | Shira | A63B 60/00 473/331 |
| 6,475,099 | B1 | 11/2002 | Sumitomo et al. | |
| 7,014,568 | B2 | 3/2006 | Pelz | |
| 7,278,928 | B2 | 10/2007 | Newman et al. | |
| 7,285,057 | B2 | 10/2007 | Mann, Jr. et al. | |
| 7,559,850 | B2 | 7/2009 | Gilbert et al. | |
| 7,662,049 | B2 | 2/2010 | Park et al. | |
| 7,674,188 | B2 | 3/2010 | Ban | |
| 7,780,549 | B2 | 8/2010 | Park et al. | |
| 7,846,033 | B2 | 12/2010 | Kato et al. | |
| 7,918,747 | B2 | 4/2011 | Johnson et al. | |
| 7,976,404 | B2 | 7/2011 | Golden et al. | |
| 8,012,036 | B2 | 9/2011 | Makamura | |
| 8,105,180 | B1 | 1/2012 | Cackett et al. | |
| 8,109,840 | B2 | 2/2012 | Gilbert et al. | |
| 8,118,688 | B2 | 2/2012 | Nakamura | |
| 8,172,699 | B2 | 5/2012 | Nakamura | |
| 8,182,359 | B2 | 5/2012 | Gilbert et al. | |
| 8,206,240 | B2 | 6/2012 | Park et al. | |
| 8,506,420 | B2 | 8/2013 | Hocknell et al. | |
| 8,672,773 | B2 | 3/2014 | Finn | |
| 8,684,861 | B2 | 4/2014 | Carlyle et al. | |
| 8,696,490 | B2 | 4/2014 | Ban | |
| 8,740,717 | B2 | 6/2014 | Stites | |
| 8,758,162 | B2 | 6/2014 | Ban | |
| 8,827,832 | B2 | 9/2014 | Breier et al. | |
| 8,827,833 | B2 | 9/2014 | Amano et al. | |
| 8,858,361 | B2 | 10/2014 | Ripp et al. | |
| 8,979,670 | B2 | 3/2015 | Aguayo et al. | |
| 9,022,876 | B2 | 5/2015 | Snyder et al. | |
| 9,033,820 | B2 | 5/2015 | Kato | |
| 9,149,692 | B2 | 10/2015 | Shimahara | |
| 9,174,099 | B2 | 11/2015 | Greaney et al. | |
| 9,308,421 | B2 | 4/2016 | Ban et al. | |
| 9,403,068 | B2 | 8/2016 | Golden et al. | |
| 9,427,632 | B2 | 8/2016 | Breier et al. | |
| 9,504,885 | B2 | 11/2016 | Ban | |
| 9,539,477 | B2 | 1/2017 | Ripp et al. | |
| 9,566,480 | B2 | 2/2017 | Voges | |
| 9,682,291 | B2 | 6/2017 | Chao | |
| 9,579,550 | B2 | 7/2017 | Aguayo et al. | |
| 9,901,789 | B2 | 2/2018 | Kitagawa et al. | |
| 2002/0025861 | A1 | 2/2002 | Ezawa | |
| 2004/0038745 | A1 | 2/2004 | Ahlqvist | |
| 2006/0234805 | A1 * | 10/2006 | Gilbert | A63B 53/047 473/290 |
| 2010/0279787 | A1 | 11/2010 | Stites et al. | |
| 2011/0165963 | A1 | 7/2011 | Cackett et al. | |
| 2011/0275451 | A1 | 11/2011 | Chao | |
| 2011/0275457 | A1 | 11/2011 | Chao et al. | |
| 2014/0274452 | A1 | 9/2014 | Oldknow | |
| 2015/0018119 | A1 | 1/2015 | Breier et al. | |
| 2015/0045142 | A1 | 2/2015 | Moreira et al. | |
| 2015/0217168 | A1 | 8/2015 | Yukawa | |
| 2015/0360091 | A1 * | 12/2015 | Ban | A63B 53/0466 473/331 |
| 2016/0354652 | A1 * | 12/2016 | Ban | A63B 53/0466 |

FOREIGN PATENT DOCUMENTS

| | | | | |
|---|---|---|---|---|
| JP | 62-144674 | | 6/1987 | |
| JP | 62-144674 | A * | 6/1987 | A63B 53/04 |
| JP | 2000176058 | | 6/2000 | |
| JP | 2001170226 | | 6/2001 | |
| JP | 2008272771 | | 11/2008 | |
| JP | 2012120921 | | 6/2012 | |
| JP | 2013043092 | | 3/2013 | |
| WO | 2012024555 | | 2/2012 | |

OTHER PUBLICATIONS

Don Patton, "The Rules on Groove Types on Golf Clubs," Golfsmith. Retrieved from the Internet. Retrieved on Jul. 20 2015, URL: <http://golftips.golsmith.com/rules-grooves-types-golf-clubs-2373.html/>.

Frank Thomas, "Sharpening Your Grooves," Frankly Golf. Retrieved from the Internet. Retrieved on Jul. 20, 2015, URL: <http://franklygolf.com/sharpeningyourgrooves.aspx/>.

* cited by examiner

GOLF CLUB HEAD HAVING SURFACE FEATURES THAT INFLUENCE GOLF BALL SPIN

CROSS-REFERENCE TO RELATED APPLICATIONS

This claims the benefit of U.S. patent application Ser. No. 15/262,904, filed on Sep. 12, 2016, U.S. Provisional Patent Appl. No. 62/217,276, filed on Sep. 11, 2015, U.S. Provisional Patent Appl. No. 62/274,832, filed on Jan. 5, 2016, and U.S. Provisional Patent Appl. No. 62/291,241, filed on Feb. 4, 2016, the contents of all of which are incorporated fully herein by reference.

FIELD OF THE INVENTION

The present disclosure relates to a golf club, and more specifically to one or more surface features on a golf club face that influence golf ball spin after impact. The surface features can reduce golf ball spin after impact at certain golf club lofts. Further, the surface features can normalize golf ball spin after impact regardless of where the golf ball is struck on the club face.

BACKGROUND

Golf clubs take various forms, for example a wood, a hybrid, an iron, a wedge, or a putter, and these clubs generally differ in head shape and design (e.g., the difference between a wood and an iron, etc.), club head material(s), shaft material(s), club length, and club loft.

Woods and hybrids generally have a longer shaft and lower loft than irons and wedges. Thus, a golf ball struck with a wood or a hybrid generally travels a greater distance than a golf ball struck with an iron or a wedge. In addition to shaft length and club loft, golf ball spin rate affects distance. At impact between the golf club and the golf ball, spin is imparted on the golf ball in the form of backspin and sidespin. While a certain amount of backspin is needed to generate sufficient lift to keep the ball in the air, too much backspin can negatively affect overall carry distance. For example, when comparing two ball flights struck with the same club but having different amounts of backspin, the ball with too much backspin will curve upward more rapidly (uplift or balloon) to a higher apex and subsequently fall more steeply (with a steeper descent angle) than the ball flight of the ball having less (or more optimal) backspin. Accordingly, the ball having too much backspin travels a shorter distance. The optimal amount of backspin, however, generally depends on the specific golf club.

As opposed to lower lofted clubs (e.g., woods, hybrids, etc.), with higher lofted clubs (e.g., wedges, 9-iron, 8-iron, 7-iron, etc.), greater amounts of backspin can be beneficial, as the focus of these clubs is less on distance and more on accuracy and, a steeper descent angle generated by excess backspin can assist with stopping the ball on a green. Ball spin is also generally affected by impact position on the golf club face. For example, a golf ball struck on the club face towards the toe and crown of the club head has lower backspin than a ball struck in the center or "sweet spot" of the club face. A golf ball struck on the club face towards the heel and sole of the club head has greater backspin than a ball struck on the sweet spot of the club face. As another example, a golf ball struck on the club face towards the toe or towards the heel of the club head generally has more sidespin than a ball struck on the sweet spot of the club face.

Variable amounts of backspin and sidespin imparted on the golf ball result in inconsistent distance and direction based on club face impact position.

While golf clubs have a variety of known designs, there is a need for reducing or better controlling golf ball spin, or spin rate in lower lofted golf clubs to maximize distance. There is also a need to reduce the variability of spin imparted on the golf ball on off-center hits (e.g., golf ball impact on the golf club face other than the sweet spot) by improving spin rate consistency in contact areas across the club face.

DETAILED DESCRIPTION

Figure 1:
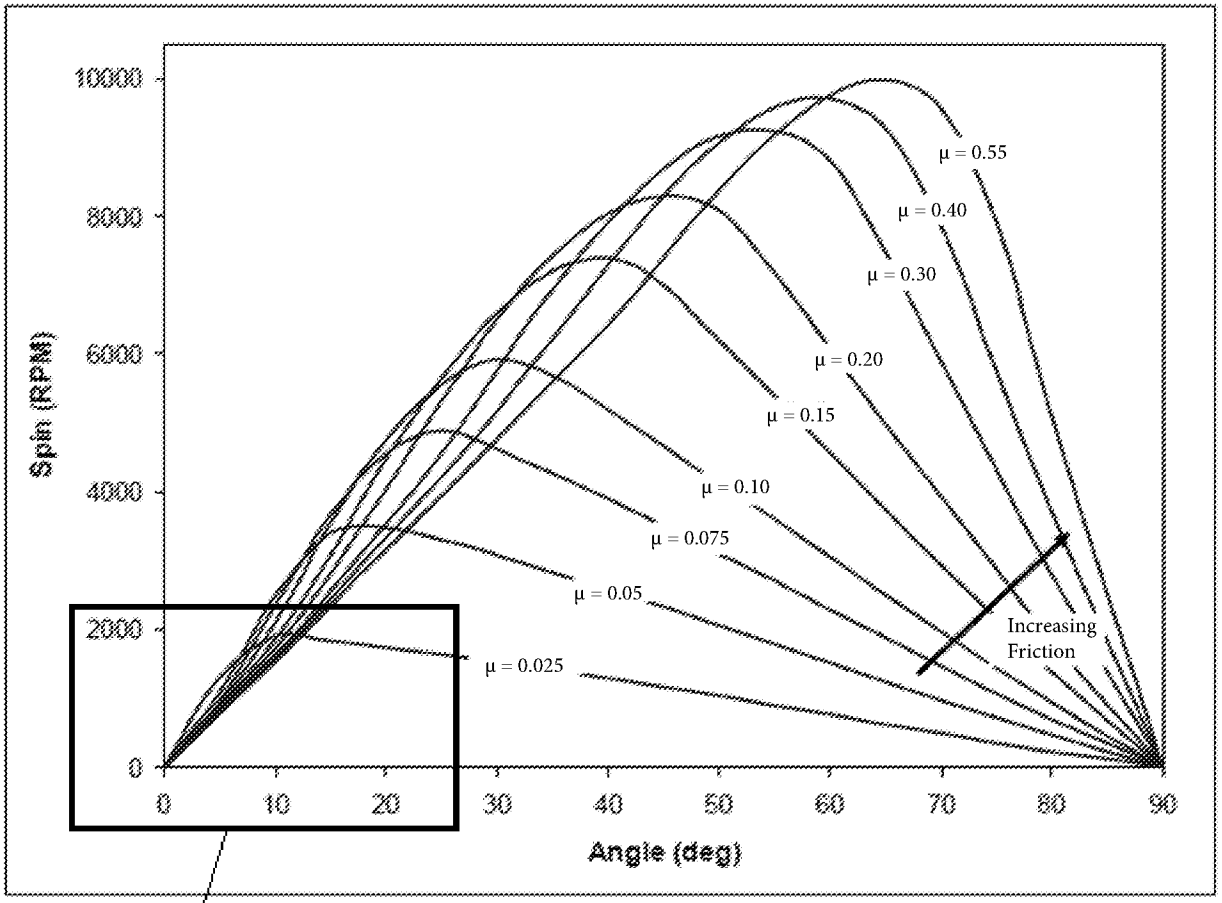
FIG. 1 is a graphical representation showing an effect of coefficient of friction μ on spin rate of an elastic object impacted by a face arranged at different angles.

One embodiment includes a club head design in which the coefficient of friction between the golf ball and the club face can be tailored or customized across the club face. The coefficient of friction can be tailored in order to normalize golf ball spin rate after impact at different locations across the club face. Distance and accuracy can be improved by making the spin rate of the golf ball (backspin, sidespin, and/or both) after impact more uniform across different impact locations on the club face.

The club face includes at least one surface feature to normalize golf ball spin rate after impact at different impact locations along the club face. The surface feature can increase or can decrease golf ball spin after impact. More specifically, the surface feature can increase or can decrease golf ball spin after impact for golf clubs having a loft below a certain loft threshold. The surface feature increases (or decreases) the coefficient of friction and decreases (or increases) golf ball spin for clubs having a loft that is less than (or less than or equal to, or not greater than) the loft threshold. The surface feature increases golf ball distance by limiting the introduction of excess backspin to the golf ball, or by introducing backspin to the golf ball, once struck with the golf club. The surface feature improves golf ball accuracy by limiting the introduction of excess sidespin to the golf ball, or by introducing sidespin to the golf ball, once struck with the golf club.

In another embodiment, one or more surface features are positioned in different areas or zones of the clubface to reduce the variability of spin imparted on the golf ball on off-center hits (e.g., contact of the golf ball with a location on the golf club face other than the sweet spot). Impact of a golf ball on different areas of the club face can generate more spin or less spin as needed to normalize due to the surface feature to normalize spin for various impact positions. At least a first surface feature can limit the introduction of excess backspin and/or excess sidespin to the golf ball based on the location of contact on the clubface. At least a second surface feature can increase the introduction of backspin and/or sidespin to the golf ball based on the location of contact on the clubface.

In one embodiment, the surface features include microgrooves that are positioned along the clubface. The microgrooves can be positioned along the entire clubface, or along one or more portions of the clubface. The microgrooves can also be positioned in one or more zones of the clubface. In a first zone, the microgrooves can be spaced close together. In a second zone, the microgrooves can be spaced further apart than the spacing in the first zone. The positioning of the zones and/or microgrooves can be related to normalizing (or decreasing the variability of) spin imparted on the golf ball at different impact locations on the club face. In golf clubs having a loft below the loft threshold, a strike of the golf ball in the first zone will impart less spin on the golf ball (due to the increase in coefficient of friction caused by more microgrooves per unit of surface area), while a strike of the golf ball in the second zone will impart more spin on the golf ball (due to the decrease in coefficient of friction caused by fewer grooves per unit of surface area). By managing the amount of spin imparted on the golf ball through the use of microgrooves, the spin rate of a golf ball is more consistent no matter the impact position on the clubface (i.e., spin rate is normalized across the club face).

In one embodiment, the surface features include a surface finish having a surface roughness on the clubface. The surface finish can have a uniform roughness across the clubface, or can have a plurality of zones or areas of different roughness across the clubface. The areas can be positioned on different areas of the clubface to improve spin rate consistency along the clubface. For example, the clubface may have a first area of roughness and a second area of roughness. The first area has a surface roughness and coefficient of friction that is less (i.e. is smoother) than the second area. In golf clubs having a loft below the loft threshold, a strike of the golf ball in the first area (or smoother area) will impart more spin on the golf ball, while a strike of the golf ball in the second area (or rougher area) will impart less spin on the golf ball. By managing the amount of spin imparted on the golf ball through surface roughness, the spin rate of a golf ball is more consistent no matter the impact position on the clubface (i.e., spin rate is normalized across the club face).

The term "golf ball spin" or "spin", as described herein, refers to the rate of rotation of the golf ball after impact by the golf club. The golf ball spin can include backspin, sidespin (e.g., hook spin, slice spin, etc.), or any combination thereof.

The term "loft" or "loft angle" of a golf club, as described herein, refers to the angle formed between the club face and the shaft, as measured by any suitable loft and lie machine.

The term "coefficient of friction (or COF)", as described herein, refers to a ratio of force required to move two surfaces past each other over the perpendicular force holding the two surfaces together. The coefficient of friction herein relates to the interaction between the golf ball and the golf club face at impact during the golf swing.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates a golf club head 10 as a wood, and more specifically a fairway wood. It should be appreciated that the fairway wood is provided for purposes of illustration of the surface features on the club face that reduce imparted golf ball spin after contact in golf clubs having a loft below a loft threshold, as disclosed herein. The disclosed club face surface features may be used on any desired wood, hybrid, or other club that has a loft at or below the loft threshold to increase the coefficient of friction between the club face and the golf ball at impact, reducing spin imparted on the golf ball. For example, the club head 10 may include, but is not limited to, a driver, a fairway wood, or a hybrid.

Referring now to the figures, FIG. 1 illustrates a graphical representation of a theoretical model showing an effect of coefficient of friction μ on spin rate of an elastic object impacted by a face arranged at different angles. The angle of the face (in degrees) is provided on the X-axis, and the spin rate (in revolutions per minute, or RPM) is provided on the Y-axis. The graphical representation was calculated using a Maw model by the United States Golf Association (USGA) to illustrate the theoretical relationship between the coefficient of friction and spin rate of the elastic object struck by a face at a given angle.

While the graphical representation is theoretical and not absolute (i.e., the underlying data is not directly applicable to golf club performance in that every golf club at a certain loft angle having a certain coefficient of friction does not impart on a golf ball the precise spin rate depicted on the Y-axis), the graphical representation does confirm a prevailing theory. More specifically, a face arranged at an angle will impart spin on an elastic object struck by the face, and as the coefficient of friction increases at that angle, the amount of spin imparted on the elastic object increases. This prevailing theory is a reason that higher lofted golf clubs (e.g., wedges, etc.) have primary, horizontally aligned grooves on the club face (e.g., grooves having a groove depth of at least 0.007 inches, etc.) rather than a smooth face—to increase the coefficient of friction between the golf ball and club face at contact in order to increase the amount of spin imparted on the golf ball, resulting in an increase in spin rate or spin of the struck golf ball. When the face angle is reduced for low lofted club heads, an increase in the coefficient of friction does not necessarily increase spin.

Unexpectedly, the graphical representation of the theoretical model indicates that at certain lower angle of the face, for example in the highlighted box 1 of FIG. 1, an increase in coefficient of friction will reduce the amount of spin imparted on the elastic object, while a decrease in coefficient of friction will increase the amount of spin imparted on the elastic object. This conclusion is counterintuitive to the prevailing theory that a higher coefficient of friction will increase the spin rate of the struck elastic object.

Based on the theoretical data depicted in FIG. 1, a loft threshold exists for a golf club where increasing the coefficient of friction increases imparted spin on a golf ball at lofts at or above this threshold, and increasing the coefficient of friction decreases imparted spin on the golf ball at lofts at or below this threshold. The loft threshold can be a loft or transition zone or range of lofts where at a given coefficient of friction, the amount of spin imparted on the golf ball changes. For example, as club lofts decrease through the loft transition zone at a given coefficient of friction, the golf club will reduce imparted spin on the golf ball rather than increase imparted spin on the golf ball. The loft threshold can be based on a neutral attack angle of the club head at impact. The loft threshold can range from approximately 15 degrees to approximately 25 degrees (including 15, 15.5, 16, 16.5, 17, 17.5, 18, 18.5, 19, 19.5, 20, 20.5, 21, 21.5, 22, 22.5, 23, 23.5, 24, 24.5, and/or 25 degrees), or be anywhere therebetween. In other embodiments, the loft threshold can be approximately 25 degrees. Golf clubs having a loft angle above the loft threshold (e.g., above approximately 25 degrees) will impart more spin on the golf ball after contact as the coefficient of friction increases. Golf clubs having a loft angle at or below the loft threshold (e.g., at or below approximately 25 degrees) will impart less spin on the golf ball after contact as the coefficient of friction increases. In other embodiments, the loft threshold can range from approximately 10 degrees to approximately 25 degrees. In still other embodiments, the loft threshold can be any suitable, known, or future identified loft or range of lofts where for a golf club having a loft angle that is at or below that loft, increasing the coefficient of friction decreases the spin imparted on the golf ball at or after contact. Further, in other embodiments, the loft threshold can vary for non-neutral attack angles at impact. For example the loft threshold can range from approximately 5 degrees to approximately 35 degrees when the attack angle of the club head varies from approximately −10 degrees to approximately 10 degrees.

As exemplified in additional detail below, golf clubs having a loft at or below the loft threshold can include one or more surface features on the club face. The one or more surface features are operable to increase the coefficient of friction between the club face and golf ball at impact. By increasing the coefficient of friction at a loft that is at or below the loft threshold, the spin imparted on the golf ball at impact is reduced. The club face can include one or more surface features in different locations across the club face. The different locations can have different coefficients of friction between the club face and golf ball at impact. By varying the coefficients of friction between the club face and golf ball at impact at different locations across the club face, the amount of spin imparted on the golf ball can be more consistent regardless of impact location.

Figure 4:
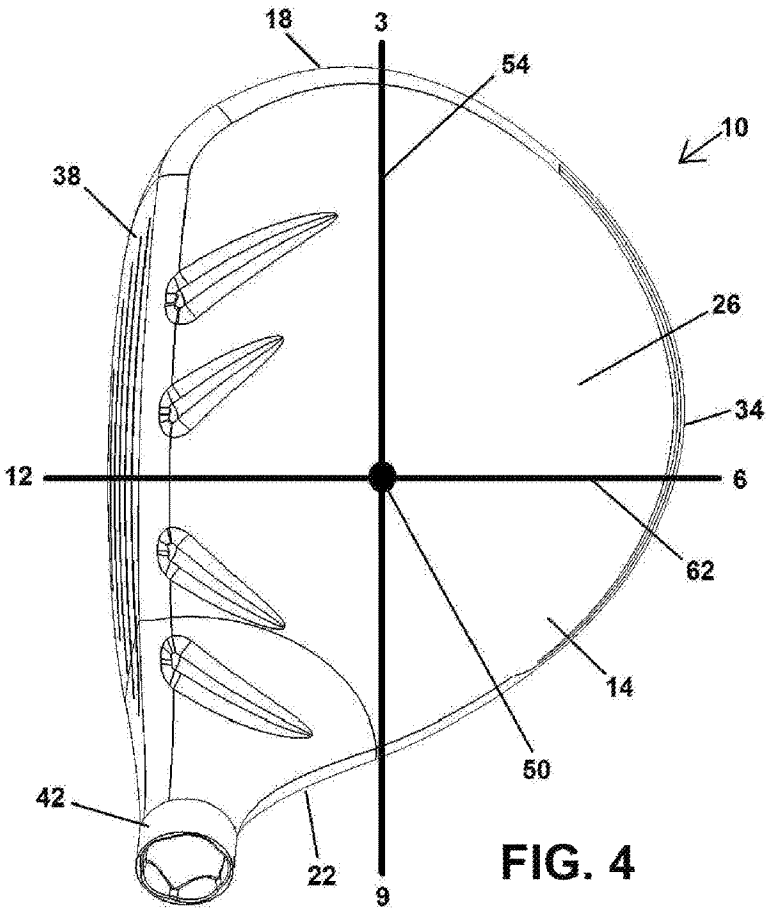
FIG. 4 is a top view of the club head of FIG. 2.
Figure 2:
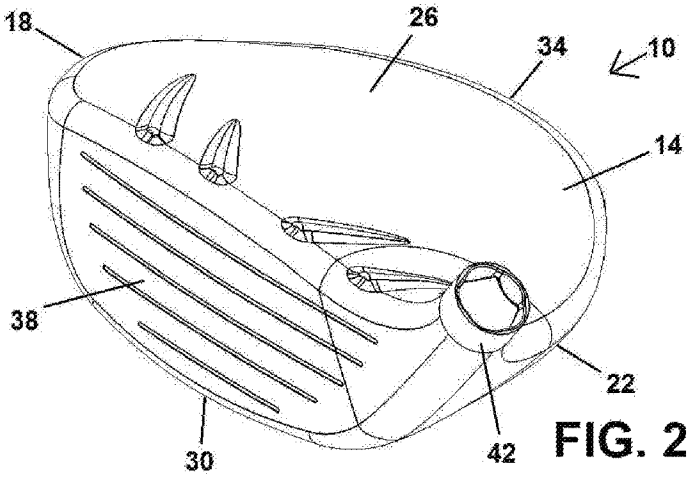
FIG. 2 is a perspective view of an embodiment of a golf club head having a club face.
Figure 3:
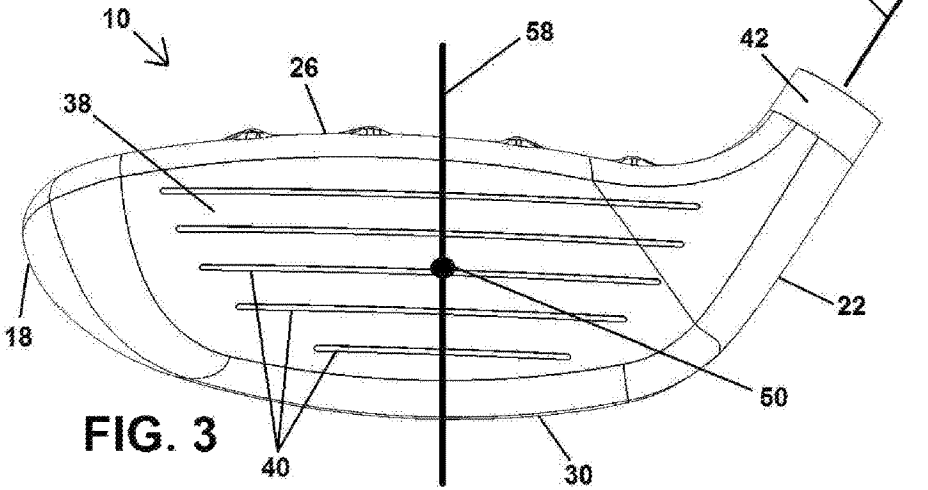
FIG. 3 is a side view of the club head of FIG. 2.

Referring now to FIGS. 2-4, an embodiment of the golf club head 10 that incorporates one or more surface features as disclosed herein, and for use with a golf club is illustrated. The golf club head 10 includes a body 14, the body 14 having a toe or toe end 18 opposite a heel or heel end 22. The body 14 also includes a crown or top 26 opposite a sole or bottom 30, and a back or rear or back end 34 opposite a club face or face or strike face or strike plate 38. A plurality of grooves or primary grooves 40 (shown in FIG. 3) are positioned on the club face 38. The golf club head 10 also includes a hosel 42 having a hosel axis 46 (shown in FIG. 3) that extends through the center of the hosel 42. The hosel 42 is configured to receive a golf club shaft (not shown) that carries a grip (not shown). A golfer grasps the grip (not shown) while swinging the golf club.

Referring to FIGS. 3 and 4, the golf club head 10 includes a center of gravity or CG 50 (shown in FIG. 4) that defines an origin of a coordinate system including an x-axis 54, a y-axis 58, and a z-axis 62. The x-axis 54 (shown in FIG. 4) extends through the club head 10 center of gravity 50 from the toe end 18 to the heel end 22. The y-axis 58 (shown in FIG. 3) extends through the club head 10 center of gravity 50 from the crown 26 to the sole 30. The z-axis 62 extends through the center of gravity 50 of the club head 10 from the club face 38 to the back 34. For additional guidance in describing the innovation herein, the x-axis 54 and the z-axis 62 are arranged to coincide with numbers on an analog clock in FIG. 4. The z-axis 62 extends between 12 o'clock ("12" through the club face 38) and 6 o'clock ("6" through the back 34), and the x-axis 54 extends between 3 o'clock ("3" through the toe end 18) and 9 o'clock ("9" through the heel end 22).

Various embodiments of the golf club head 10 are illustrated having a surface feature 100 on the club face 38 operable to increase the club face coefficient of friction between the club face 38 and the golf ball to reduce spin imparted on the golf ball at impact. In many embodiments, the surface feature 100 can increase the coefficient of friction between the club face 38 and the golf ball to greater than approximately 0.20, greater than approximately 0.25, greater than approximately 0.30, greater than approximately 0.35, greater than approximately 0.40, greater than approximately 0.45, or greater than approximately 0.50.

In many embodiments, the club face 38 having the surface feature 100 to normalize ball spin for various impact locations can have a reduced bulge and/or roll. For example, the club face 38 having the surface feature 100 can have a bulge of greater than 14 inches, greater than 15 inches, greater than 16 inches, greater than 17 inches, greater than 18 inches, greater than 19 inches, or greater than 20 inches. For example, in some embodiments, the bulge of the club face 38 can be approximately 14-16 inches, approximately 14-17 inches, approximately 15-17 inches, or approximately 15-18 inches. For further example, the club face 38 having the surface feature 100 can have a roll of greater than 14 inches, greater than 15 inches, greater than 16 inches, greater than 17 inches, greater than 18 inches, greater than 19 inches, or greater than 20 inches. For example, in some embodiments, the roll of the club face 38 can be approximately 14-16 inches, approximately 14-17 inches, approximately 15-17 inches, or approximately 15-18 inches.

I. Microgrooves

Figure 5:
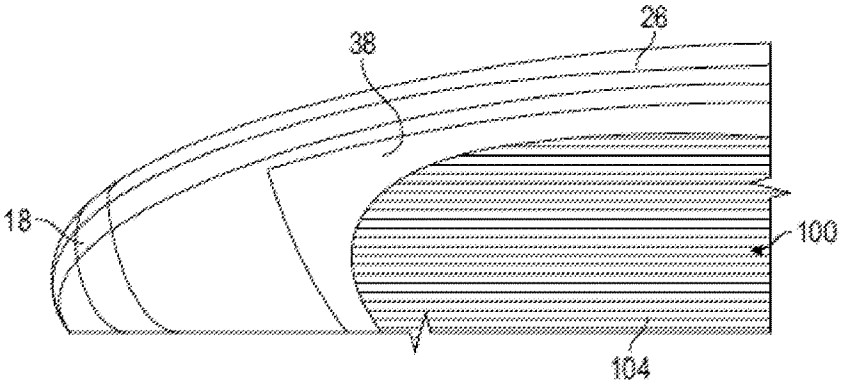
FIG. 5 is a partial side view of an embodiment of the golf club head of FIG. 2 illustrating a portion of the club face having a surface feature in the form of microgrooves.
Figure 6:
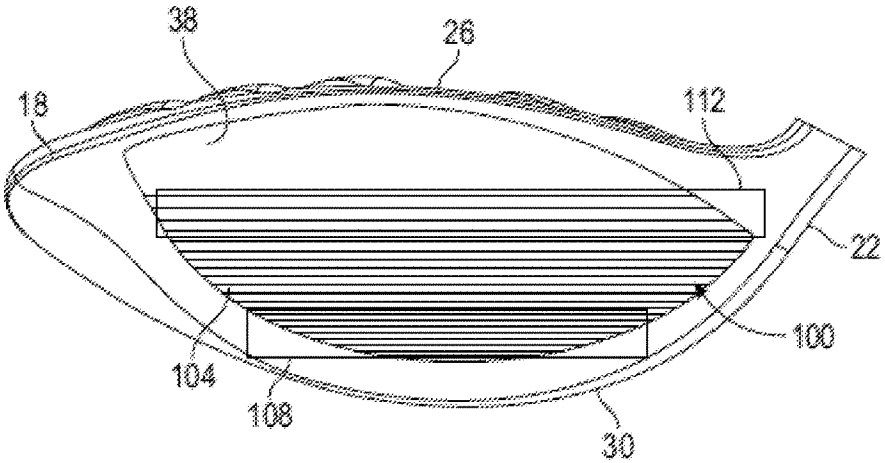
FIG. 6 is a side view of an embodiment of the golf club head of FIG. 2 illustrating the club face with microgrooves separated into a plurality of zones, each zone having different spacing between consecutive microgrooves.

Referring now to FIGS. 5-6, in the illustrated embodiments, the surface feature 100 comprises a plurality of microscopic grooves or microgrooves 104 positioned on the club face 38. In many embodiments, the microgrooves 104 can increase the coefficient of friction between the club face 38 and the golf ball to greater than approximately 0.20, greater than approximately 0.25, greater than approximately 0.30, greater than approximately 0.35, greater than approximately 0.40, greater than approximately 0.45, or greater than approximately 0.50.

In the embodiments illustrated in FIGS. 5-6, the microgrooves 104 have a groove depth of approximately 0.003 inches. However, in other embodiments, the microgrooves 104 can have a groove depth of approximately 0.001 inches to approximately 0.050 inches, and more specifically can have a groove depth of approximately 0.002 inches to approximately 0.0065 inches. In other embodiments, the microgrooves 104 can have a groove depth of approximately 0.0015 inches to approximately 0.0050 inches. Further, in other embodiments, the microgrooves 104 have a groove depth of approximately 0.002 inches to approximately 0.010 inches. For example, the microgroove 104 can have a groove depth of approximately 0.0015 inches, approximately 0.002 inches, approximately 0.0025 inches, approximately 0.00303 inches, approximately 0.0035 inches, approximately 0.0040 inches, approximately 0.0045 inches, or approximately 0.005 inches. The depth of the microgrooves 104 is less than the depth of the primary grooves 40. For example, the depth of the primary grooves 40 shown in FIG. 3 is approximately 0.007 inches.

In the embodiments illustrated in FIGS. 5-6, the microgrooves 104 have a groove width of approximately 0.005 inches. However, in other embodiments, the microgrooves 104 can have a groove width of approximately 0.001 inches to approximately 0.050 inches, and more specifically can have a groove width of approximately 0.002 inches to approximately 0.020 inches. In other embodiments, the microgrooves 104 can have a width of approximately 0.001 inches to approximately 0.003 inches, approximately 0.015 inches to approximately 0.050 inches, approximately 0.020 inches to approximately 0.04 inches, approximately 0.025 inches to approximately 0.030 inches, approximately 0.030 inches to approximately 0.050 inches, or approximately 0.003 inches to approximately 0.006 inches. In some embodiments, the microgrooves 104 can have a groove width of approximately 0.025 inches, approximately 0.026 inches, approximately 0.027 inches, approximately 0.028 inches, approximately 0.029 inches, or approximately 0.030 inches. The width of the microgrooves 104 is less than the width of the primary grooves 40. For example, the width of the primary grooves 40 shown in FIG. 3 is approximately 0.030 inches.

In the embodiments illustrated in FIGS. 5-6, the microgrooves 104 have different lengths (from toe 18 to heel 22) measured along the club face 38. For example, the microgrooves 104 have a shorter length (from toe 18 to heel 22) towards the sole 30 than the microgrooves 104 in the middle (or closer to the crown 26). In other embodiments, the microgrooves 104 can cover the entire club face 38, or can cover a portion of the club face 38. For example, the microgrooves 104 can be positioned at different locations along the y-axis 58 (e.g., from the club face 38 center towards the sole 30, around the club face 38 center, from the club face 38 center towards the crown 26, a combination thereof, etc.) and/or different locations along the x-axis 54 (e.g., from the heel 22 towards the toe 18, from the heel 22 towards the center 50, from the center 50 towards the toe 18, a combination thereof, etc.). The microgrooves 104 can also have different or varying lengths at different positions on the club face 38. For example, one or more microgrooves 104 can be positioned on the club face 38 on a heel 22 side of the center 50, extending towards the toe 18, heel 22, crown 26, and/or sole 30 and terminating on the heel 22 side of the center 50, approximately at or near the center 50, and/or on the toe 18 side of the center 50.

Figure 13:
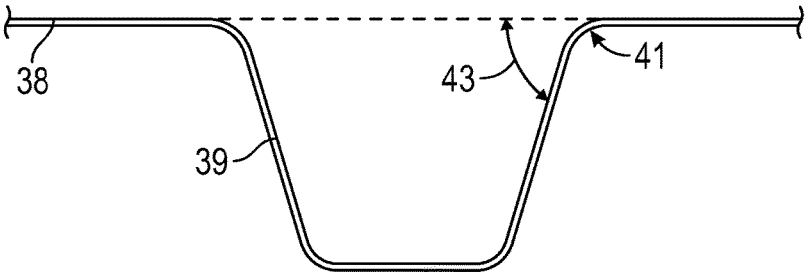
FIG. 13 is a cross-sectional view of a microgroove.

Referring to FIG. 13, the microgrooves 104 have a sidewall 39, wherein the sidewall comprises an angle 43. The angle 43 of the sidewall 39 can have a range of approximately 30 degrees to approximately 95 degrees, and more specifically can have a range of 40 degrees to 90 degrees. For example, the microgrooves 104 can have a sidewall angle 43 of approximately 40 degrees, approximately 45 degrees, approximately 50 degrees, approximately 55 degrees, approximately 60 degrees, approximately 65 degrees, approximately 70 degrees, approximately 75 degrees, approximately 80 degrees, approximately 85 degrees, or approximately 90 degrees.

Referring to FIG. 13, the microgrooves 104 have a groove edge top 41, wherein groove edge top 41 comprises of a radius. The groove edge top radius is positioned where the club face 38 integrally forms with the sidewall 39. The radius of the groove edge top 41 is measured by the radius of curvature of the groove edge top 41. The radius of the groove edge top 41 can be approximately 0.0020 inches or less, approximately 0.0016 inches or less, approximately 0.0012 inches or less, or approximately 0.0008 inches or less. For example, in some embodiments, the radius of the groove edge top 41 can be approximately 0.0004 inches, approximately 0.0006 inches, approximately 0.0008 inches, approximately 0.0010 inches, approximately 0.0012 inches, approximately 0.0014 inches, approximately 0.0016 inches, approximately 0.0018 inches, or approximately 0.0020 inches.

As another example, one or more microgrooves 104 can be positioned on the club face 38 on a toe 18 side of the center 50, extending towards the toe 18, heel 22, crown 26, and/or sole 30 and terminating on the heel 22 side of the center 50, approximately at or near the center 50, and/or on the toe 18 side of the center 50.

As another example, one or more microgrooves 104 can be positioned on the club face 38 on the crown 26 side of the center 50. The one or more microgrooves 104 can extend from a toe 18 side of the center 50 towards the toe 18, heel 22, crown 26, and/or sole 30. The one or more microgrooves 104 can also extend from a heel 22 side of the center 50 towards the toe 18, heel 22, crown 26, and/or sole 30. The one or more microgrooves 104 can further extend from at or near the center 50 towards the toe 18, heel 22, crown 26, and/or sole 30. Any of these microgrooves 104 can terminate on the crown 26 side of the center 50, terminate on the sole 30 side of the center 50, and/or terminate approximately at or near the center 50.

As an additional example, one or more microgrooves 104 can be positioned on the club face 38 on the sole 30 side of the center 50. The one or more microgrooves 104 can extend from a toe 18 side of the center 50 towards the toe 18, heel 22, crown 26, and/or sole 30. The one or more microgrooves 104 can also extend from a heel 22 side of the center 50 towards the toe 18, heel 22, crown 26, and/or sole 30. In addition, the one or more microgrooves 104 can extend from at or near the center 50 towards the toe 18, heel 22, crown 26, and/or sole 30. Any of these microgrooves 104 can terminate on the crown 26 side of the center 50, terminate on the sole 30 side of the center 50, and/or terminate approximately at or near the center 50.

In yet other embodiments, one or more microgrooves 104 can be in axial alignment, but segmented or broken apart along the axis into a plurality of axially aligned microgrooves 104. In still other embodiments, one or more microgrooves 104 can be shifted on the club face 38, with a greater amount of the microgroove 104 length being on the toe 18 side of the center 50 than on the heel 20 side of the center 50, or on the heel 20 side of the center 50 than on the toe 18 side of the center 50. In other embodiments, one or more microgrooves 104 can be generally centrally positioned on the club face 38, with generally the same amount of the microgroove 104 length being on the toe 18 side and the heel 20 side of the center 50.

In other embodiments of the club face 38, the microgrooves 104 can be intersecting or nonintersecting to one another. Stated another way, the microgrooves 104 can be parallel to each other, or can be non-parallel to each other. Further, the microgrooves 104 can be parallel to the x-axis 54 or can be oblique to the x-axis 54. In addition, the microgrooves 104 can be perpendicular to the y-axis 58 or can be oblique to the y-axis 58. The microgrooves 104 can be oriented on the club face 38 horizontally (i.e. from the toe 18 towards the heel 22). In other embodiments, the microgrooves 104 can be oriented at any desired or suitable orientation on the club face 38. For example, in other embodiments, the microgrooves 104 can be curved in any direction or can be positioned at an angle with respect to the x-axis 54. Further, the microgrooves 104 can form a repeated pattern including circles, ellipses, triangles, rectangles, or other polygons or shapes with at least one curved surface.

In addition, the microgrooves 104 can be arranged on the club face 38 to form a straight line or a spline. In other embodiments, the microgrooves 104 can be curved or arcuate along a portion of the club face 38. In yet other embodiments, a mix of straight and arcuate microgrooves 104 can be arranged on one or more portions of the club face 38, and in still other embodiments one or more of the microgrooves can be straight along a portion of its length and curved or arcuate along another portion of its length.

In still other embodiments of the club face 38, one or more microgrooves 104 can have a constant cross-sectional area (viewed normally to the club face 38) along the length of the groove 104. Optionally or alternatively, one or more microgrooves 104 can have a variable or changing cross-sectional area along the length of the microgroove 104 (e.g., the cross-sectional area at a first portion or section or location of the microgroove 104 is different that the cross-sectional area at a second portion or section or location of the same groove 104, etc.).

In other embodiments of the club face 38, the cross-sectional shape of the microgrooves 104 can include, but is not limited to, box-shaped, V-shaped, U-shaped, or any other preferred cross-sectional shape.

It should be appreciated that in various embodiments, the microgrooves 104 can have any suitable combination of width, depth, length, orientation, arrangement, and/or cross-sectional shape, as disclosed herein. In addition, at least one microgroove 104 can have a different combination of width, depth, length, orientation, arrangement, and/or cross-sectional shape than another microgroove 104 on the club face 38. In other embodiments, the microgrooves 104 can be positioned with or without primary grooves 40 on the club face 38.

As illustrated in FIG. 5, the microgrooves 104 are spaced a uniform distance between consecutive microgrooves 104. As illustrated in FIG. 6, the microgrooves 104 are spaced or arranged at varying distances between consecutive microgrooves 104. In many embodiments, the spacing between the microgrooves 104 can be approximately 3 to 3.5 times greater than the width of the microgrooves 104. In many embodiments, the spacing between the microgrooves 104 can be approximately 0.070 inches to approximately 0.090 inches, and more specifically can be approximately 0.075 inches to approximately 0.085 inches. In some embodiments, the spacing between the microgrooves 104 can be approximately 0.075 inches, approximately 0.077 inches, approximately 0.079 inches, approximately 0.081 inches, approximately 0.083 inches, or approximately 0.085 inches. In other embodiments, the spacing between microgrooves 104 can be approximately 0.003 inches to approximately 0.10 inches, approximately 0.003 inches to approximately 0.0035 inches, approximately 0.010 inches to approximately 0.080 inches, approximately 0.020 inches to approximately 0.070 inches, approximately 0.050 inches to approximately 0.010 inches, or approximately 0.009 inches to approximately 0.018 inches.

The spacing between microgrooves 104 has a direct effect on coefficient of friction. In areas with increased spacing between consecutive microgrooves 104 (i.e. an area with fewer microgrooves 104 per unit of area), the coefficient of friction is lower. Thus, for golf clubs at or below the loft threshold, more spin is imparted on the golf ball in these areas of lower coefficient of friction. In areas with decreased spacing between consecutive microgrooves 104 (i.e. an area with more microgrooves 104 per unit of area), the coefficient of friction is higher. Thus, for golf clubs at or below the loft threshold, less spin is imparted on the golf ball in these areas of higher coefficient of friction.

The variable spacing between microgrooves 104 in FIG. 6 is illustrated by a plurality of zones 108, 112 on the club face 38. In a first zone 108, which is closer to the sole 30 than the crown 26, the microgrooves 104 are spaced or arranged at a reduced distance between consecutive microgrooves 104 than in a second zone 112, which is closer to the crown 26 than the sole 30. In other embodiments, one or more zones 108, 112 can be positioned at any desired or suitable location along the club face 38. In another embodiment, the microgrooves 104 can have an incremental or gradual increase in distance between adjacent microgrooves 104. For example, the microgroove 104 closest to the sole 30 can be spaced from the next, adjacent microgroove 104 by a distance of approximately 0.0201 inches. The distance between each adjacent microgroove 104 then increases by 0.002 inches from the sole 30 to the crown 26 (e.g., 0.0201 inch spacing, then 0.0221 inch spacing, then 0.0241 inch spacing, etc.). In other embodiments, the spacing between consecutive microgrooves 104 can be variable or constant across the club face 38. For example, the distance between consecutive microgrooves 104 can be smaller towards the sole 30, greater towards the middle, and then smaller again towards the crown 26. As another example, the distance between consecutive microgrooves 104 can be constant, an increasing increment, a decreasing increment, or a combination thereof across the club face 38 (e.g. from sole 30 to crown 26, crown 26 to sole 30, toe 18 to heel 22, heel 22 to toe 18, etc.).

During a swing, the club head 10 rotates about the hosel axis 46 to square the club face 38 at impact with the golf ball. Squaring the club face 38 during a swing promotes the desired ball direction. At impact, the position of contact of the golf ball on the club face 38, relative to the head center of gravity 50 position, affects the spin of the golf ball, or the gear effect. During flight, the golf ball spins or rotates about an axis. The axis of rotation of the golf ball can be broken down into components including a vertical axis perpendicular to a ground plane, and a horizontal axis parallel to a ground plane. The component of spin of the golf ball about the vertical axis affects ball direction. The component of spin of the golf ball about the horizontal axis affects trajectory and distance. The gear affect is described in further detail in the example below.

For example, impact of the golf ball on the club face 38, offset from the head center of gravity 50 along the x-axis 54, causes the club head 10 to rotate about the y-axis 58 in a first direction, thereby imparting a component of spin on the golf ball about its vertical axis in a second direction opposite the first direction (e.g., sidespin). The component of spin of the golf ball about its vertical axis affects the fade or draw of the golf ball. Similarly, impact of the golf ball on the club face 38, offset from the head center of gravity 50 along the y-axis 58, causes the club head 10 to rotate about the x-axis 54 in a third direction, thereby imparting a component of spin on the golf ball about the horizontal axis in a fourth direction opposite the third direction (e.g., backspin or topspin). The component of spin of the golf ball about the horizontal axis affects the trajectory and distance of the golf ball.

To address the gear effect impact on backspin, and thus trajectory and distance, the distance between consecutive microgrooves 104 on the club face 38 is less towards the sole 30 (i.e., an area with more microgrooves 104 per unit of area, or an area of higher concentration of microgrooves) than towards the crown 26. This is because a golf ball struck on the club face 38 towards the sole 30 generally results in more spin, and in particular backspin, being imparted on the golf ball than a golf ball struck on the club face 38 towards the crown 26 due to the gear effect. By placing a higher concentration of microgrooves 104 towards the sole 30, the coefficient of friction is increased in that area of the club face 38, and less spin is imparted on the golf ball for golf clubs at or below the loft threshold.

Similarly, by placing a lower concentration of microgrooves 104 towards the crown 26 (or no microgrooves on the club face 38 towards the crown 26), the coefficient of friction is decreased in that area of the club face 38, and more spin is imparted on the golf ball for golf clubs at or below the loft threshold. This counteracts the lack of spin imparted on the golf ball due to the gear effect.

Further, by placing microgrooves 104 offset from the center towards the toe 18 and/or heel 22 of the club face 38, sidespin can be reduced. This is because a golf ball struck on the club face 38 towards the toe 18 or heel 22 generally results in more spin, and in particular sidespin, being imparted on the golf ball than a golf ball struck on the club face 38 towards the center (or sweet spot) due to the gear effect. By placing a higher concentration of microgrooves 104 on the clubface 38 towards the toe 18 and/or heel 22, the coefficient of friction is increased in those areas of the club face 38, and less spin is imparted on the golf ball for golf clubs at or below the loft threshold. This can address the gear effect impact on sidespin, and thus accuracy, by addressing the amount of fade or draw of the golf ball.

Figure 14:
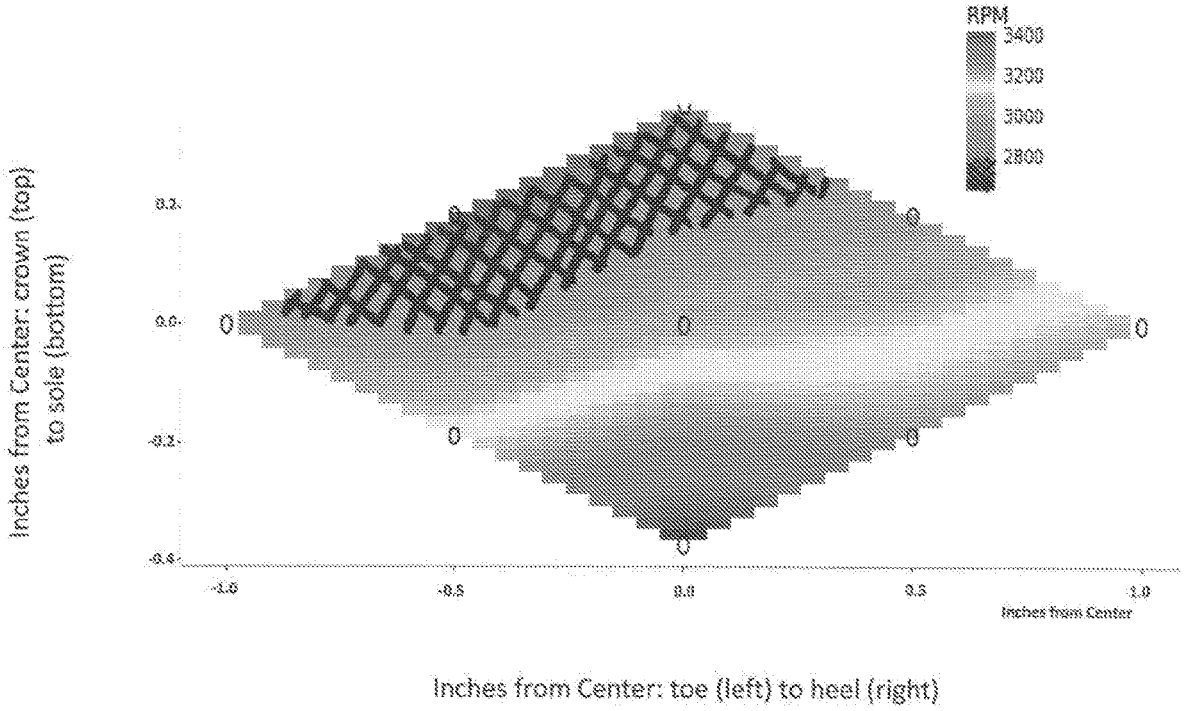
FIG. 14 illustrates the backspin on a golf ball resulting from impacts of the golf ball on various positions of the club face.

Referring to FIG. 14, the backspin resulting from impacts of a golf ball on various positions of the club face 38 of an exemplary golf club head 10 (while maintaining additional parameters such as swing speed, impact speed, impact angle, etc. constant) are illustrated. FIG. 14 illustrates that higher backspin is observed for impact positions near the sole 30 and near the heel 22 of the club face 38, while lower backspin is observed for impact positions near the crown 26 and near the toe 18 of the club face 38. For example, a region of the face 38 near the sole 30 and near the heel 22 generates approximately 3200-3400 revolutions per minute (RPM) of backspin on impact with a golf ball, compared to a region of the face 38 near the crown 26 and near the toe 18, which generates less than approximately 3000 RPM of backspin on impact with a golf ball.

Accordingly, in some embodiments, to normalize backspin for various impact locations on the club face 38, the first zone 108 can be positioned closer to the sole 30 and closer to the heel 22 than the second zone 112 which can be positioned closer to the crown 26 and the toe 18. In these embodiments, the microgrooves 104 can have reduced spacing (i.e. higher density or concentration) in the first zone 108 and increased spacing (i.e. lower density or concentration) in the second zone 112. For example, in some embodiments, the first zone 108 can have an increased number of microgrooves 104, and/or a reduced microgroove pitch compared to the second zone 112. Accordingly, the coefficient of friction between the club face in the first zone 108 and a golf ball is greater than the coefficient of friction between the club face in the second zone 112 and the golf ball.

Figure 7:
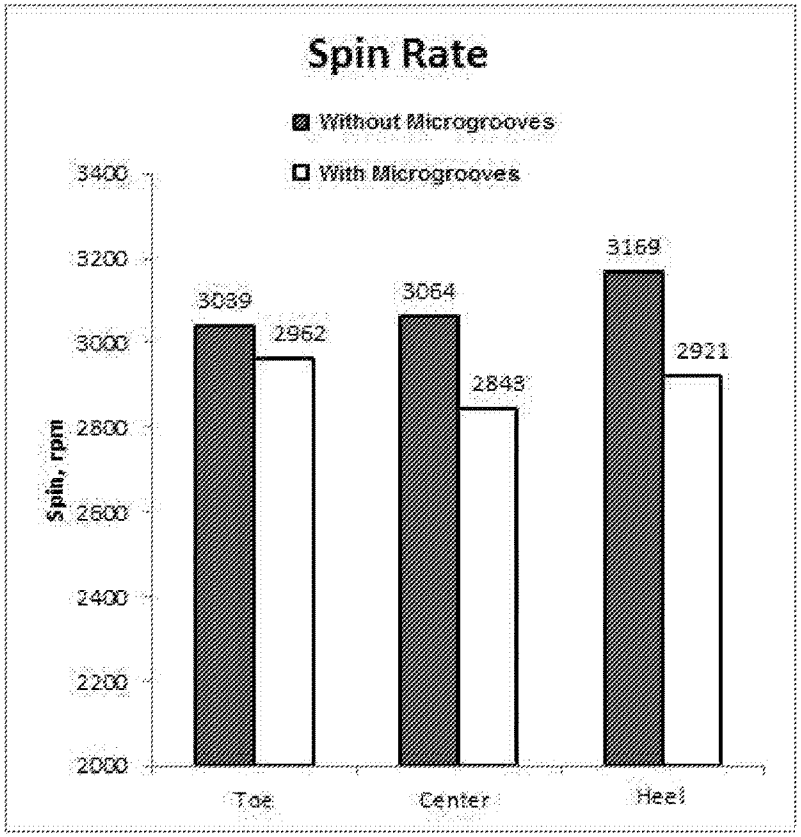
FIG. 7 is a table providing data comparing golf ball spin rate at different club face impact locations for clubs without microgrooves and for clubs with microgrooves, the golf clubs having a square impact position.
Figure 9:
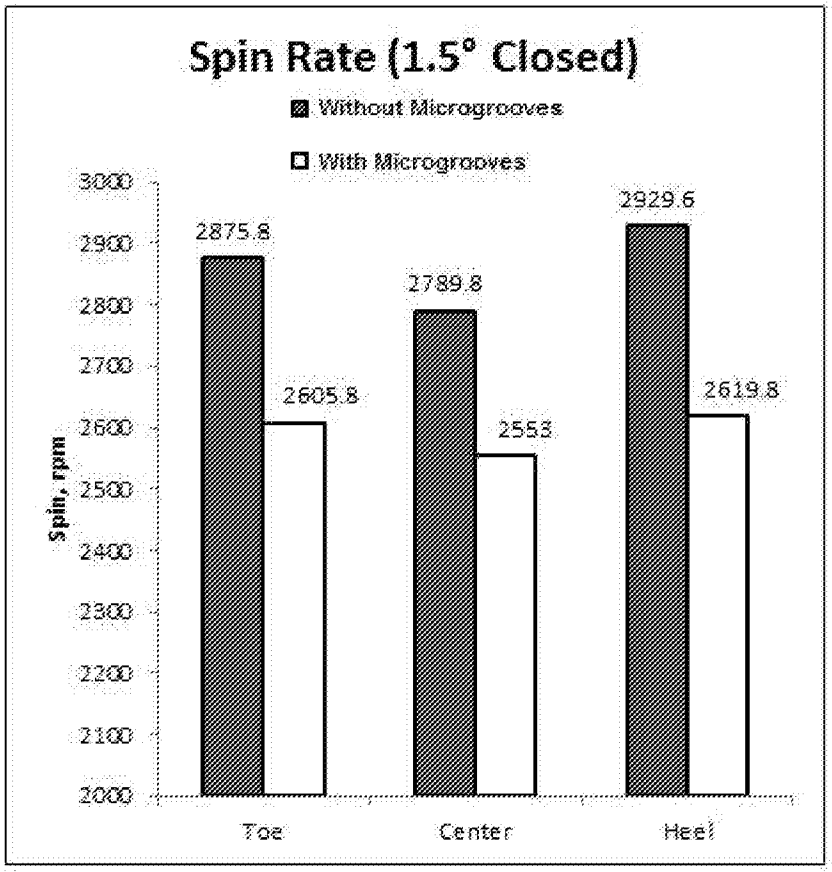
FIG. 9 is a table providing data comparing golf ball spin rate at different club face impact locations for clubs without microgrooves and for clubs with microgrooves, the golf clubs having a closed impact position.
Figure 8:
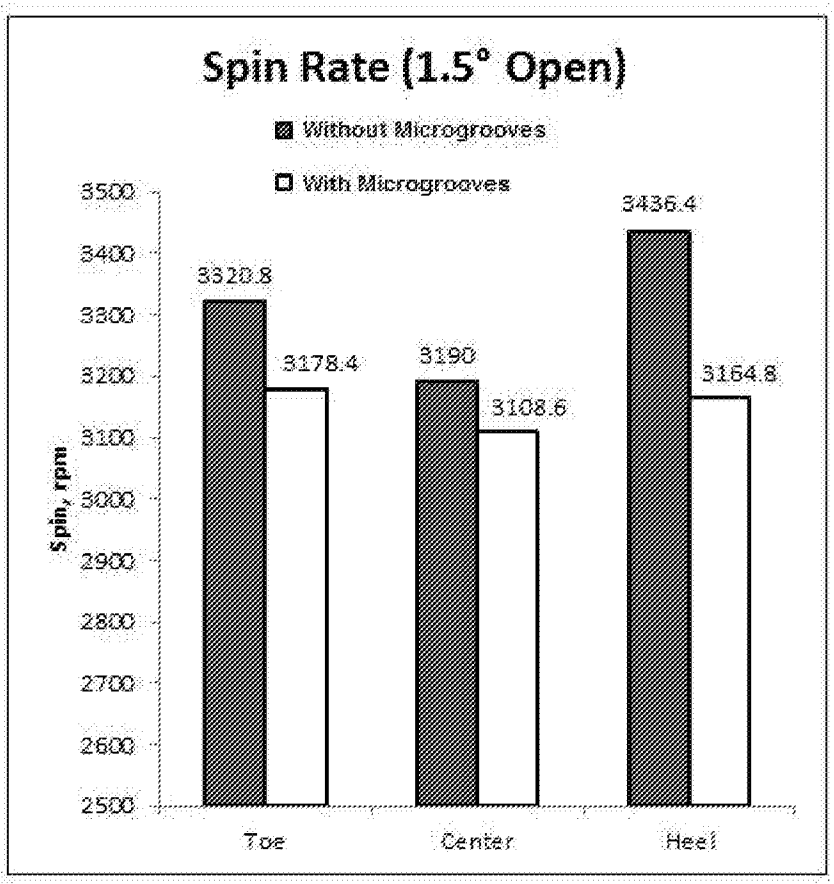
FIG. 8 is a table providing data comparing golf ball spin rate at different club face impact locations for clubs without microgrooves and for clubs with microgrooves, the golf clubs having an open impact position.

FIGS. 7-9 provide data that illustrates the effect on spin rate of golf clubs with microgrooves 104 in comparison with golf clubs without microgrooves 104. More specifically, the data reflects that golf clubs with microgrooves 104 that increase the coefficient of friction between the golf ball and club face 38 in golf clubs at or below the loft threshold decrease the spin imparted on the golf ball at impact (i.e.

decrease the spin rate after impact) than golf clubs at or below the loft threshold without microgrooves 104.

Referring to FIG. 7, the spin rate of a golf ball struck by a golf club without microgrooves is compared to the spin rate of a golf ball struck by a golf club with microgrooves when the golf clubs have a square position at impact. The impact positions on the club face 38 compared include (1) offset from the center of the club face 38 towards the toe 18, (2) at the center of the club face 38, and (3) offset from the center of the club face 38 towards the heel 22. In all three impact positions, the golf club having microgrooves (e.g. having an increased coefficient of friction between the golf ball and the club face 38) had a greater reduction in spin rate than a golf club that did not have microgrooves (e.g. having a decreased coefficient of friction between the golf ball and the club face 38). More specifically, the golf club without microgrooves had a spin rate of 3039 RPM for impact positions towards the toe 18 of the club face 38, 3064 RPM for impact positions at the center of the club face 38, and 3169 RPM for impact positions towards the heel 22 of the club face 38. In comparison, the golf club with microgrooves had a spin rate of 2962 RPM for impact positions towards the toe 18, 2843 RPM for impact positions at the center of the club face 38, and 2921 RPM for impact positions towards the heel 22.

Referring to FIG. 8, the spin rate of a golf ball struck by a golf club without microgrooves is compared to the spin rate of a golf ball struck by a golf club with microgrooves when the golf clubs are 1.5 degrees open at impact. The impact positions on the club face 38 compared include (1) offset from the center of the club face 38 towards the toe 18, (2) at the center of the club face 38, and (3) offset from the center of the club face 38 towards the heel 22. In all three impact positions, the golf club having microgrooves (e.g. having an increased coefficient of friction between the golf ball and the club face 38) had a greater reduction in spin rate than a golf club that did not have microgrooves (e.g. having a decreased coefficient of friction between the golf ball and the club face 38). More specifically, the golf club without microgrooves had a spin rate of 3320.8 RPM for impact positions towards the toe 18 of the club face 38, 3190 RPM for impact positions at the center, and 3436.4 RPM for impact positions towards the heel 22 of the club face 38. In comparison, the golf club with microgrooves had a spin rate of 3178.4 RPM for impact positions towards the toe 18 of the club face 38, 3108.6 RPM for impact positions at the center, and 3164.8 RPM for impact positions towards the heel 22 of the club face 38.

Referring to FIG. 9, the spin rate of a golf ball struck by a golf club without microgrooves is compared to the spin rate of a golf ball struck by a golf club with microgrooves when the golf clubs are 1.5 degrees closed at impact. The impact positions on the club face 38 compared include (1) offset from the center of the club face 38 towards the toe 18, (2) at the center of the club face 38, and (3) offset from the center of the club face 38 towards the heel 22. In all three impact positions, the golf club having microgrooves (e.g. having an increased coefficient of friction between the golf ball and the club face 38) had a greater reduction in spin rate than a golf club that did not have microgrooves (e.g. having a decreased coefficient of friction between the golf ball and the club face 38). More specifically, the golf club without microgrooves had a spin rate of 2875.8 RPM for impact positions towards the toe 18 of the club face 38, 2789.8 RPM for impact positions at the center, and 2929.6 RPM for impact positions towards the heel 22 of the club face 38. In comparison, the golf club with microgrooves had a spin rate of 2605.8 RPM for impact positions towards the toe 18 of the club face 38, 2553 RPM for impact positions at the center, and 2619.8 RPM for impact positions towards the heel 22 of the club face 38.

II. Surface Roughness

Figure 10B:
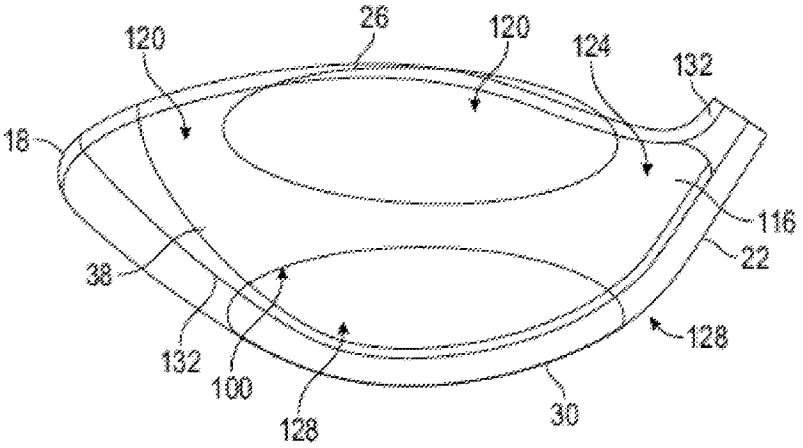
FIG. 10B is a front view of an embodiment of the golf club head of FIG. 2 illustrating the club face with different areas of surface roughness.
Figure 10A:
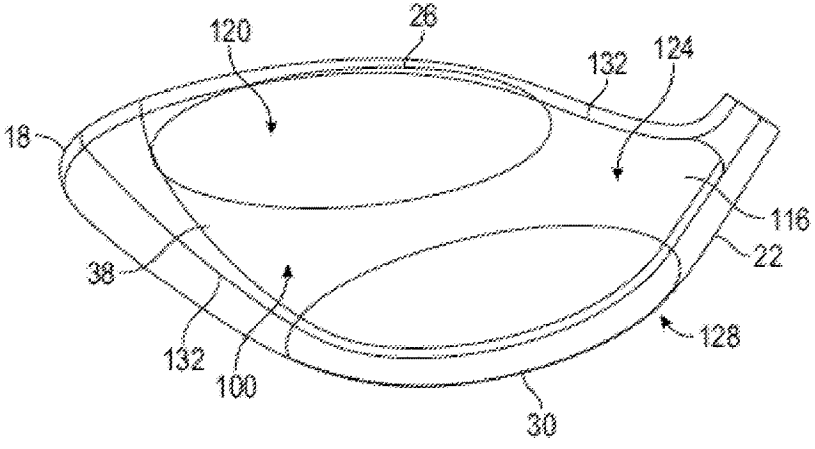
FIG. 10A is a front view of an embodiment of the golf club head of FIG. 2 illustrating the club face with different areas of surface roughness.

Referring now to FIGS. 10A and 10B, another embodiment of the golf club head 10 is illustrated having a surface feature 100 on the club face 38 operable to increase the coefficient of friction to reduce spin imparted on the golf ball at impact. In the illustrated embodiment, the surface feature 100 is a surface roughness or surface finish 116 positioned on the club face 38. More specifically, the surface roughness 116 is a surface texture generally expressed by deviations in the direction of a vector normal to the surface. The deviations are quantified herein by a distance (i.e. microinches), with a greater distance indicating a less smooth (or a more rough) surface. However, in other embodiments, the surface roughness 116 can be quantified by any known or suitable metric.

In many embodiments, the surface roughness 116 can increase the coefficient of friction between the club face 38 and the golf ball to greater than approximately 0.20, greater than approximately 0.25, greater than approximately 0.30, greater than approximately 0.35, greater than approximately 0.40, greater than approximately 0.45, or greater than approximately 0.50.

In some embodiments, the surface feature 100 can comprise a single surface roughness 116 from approximately 0 microinches to approximately 300 microinches. In some embodiments, the surface feature 100 can comprise a single surface roughness 116 between approximately 40 microinches to approximately 180 microinches. For example, the surface roughness 116 can be approximately 40 microinches, approximately 60 microinches, approximately 80 microinches, approximately 100 microinches, approximately 120 microinches, approximately 140 microinches, approximately 160 microinches, or approximately 180 microinches.

The surface roughness 116 can be divided into a plurality of surface roughness areas or zones 120, 124, 128 on the club face 38, with each area having a different amount or quantity of surface roughness. By varying the surface roughness between areas 120, 124, 128 on the club face 38, the coefficient of friction between the golf ball and the club face 38 can be tailored or customized across the club face 38 to address golf ball spin variability across the club face 38 caused by the gear effect. Stated another way, golf ball spin rate after impact can be normalized (e.g., made more uniform, variability is reduced, etc.) at different impact locations along the club face 38. This advantageously can reduce (or increase) spin imparted on the golf ball at different impact positions other than the sweet spot (e.g., a mishit, etc.), counteracting the gear effect to improve distance and accuracy.

For golf clubs at or below the loft threshold, more spin is imparted on the golf ball in areas that have a highly polished or smooth surface finish, as the coefficient of friction between the club face 38 and the golf ball is reduced. Similarly, less spin is imparted on the golf ball in areas that have a rougher or less smooth surface finish, as the coefficient of friction between the club face 38 and the golf ball is increased. Generally, as surface roughness increases, the coefficient of friction increases, and the amount of spin imparted on the golf ball at impact decreases.

While FIGS. 10A and 10B illustrate embodiments of a golf club head 10 having three surface roughness areas or zones 120, 124, 128 on the club face 38, it should be appreciated that in other embodiments of a golf club head 10 any number of areas or zones of surface roughness can be positioned on the club face 38 (e.g., one, two, three, four, or five or more areas or zones of surface roughness). It should also be appreciated that while the disclosure below references a first, second, and third surface roughness area or zone 120, 124, 128, the terms first, second, and third are used to distinguish between the areas or zones on the club face 38. The terms first, second, and third are interchangeable to distinguish between areas or zones 120, 124, 128 (e.g., the third area 128 can be referred to as the second area or the first area, the second area 124 can be referred to as the third area or the first area, etc.), and are not intended to be limiting.

Referring back to FIG. 10A, in the first surface roughness area 120, which is positioned towards the crown 26 side of the center and extends towards the toe 18, the surface roughness is smoother than the second and third roughness areas 124, 128. The surface roughness in the first area 120 can be approximately 0 microinches to approximately 100 microinches, and more specifically can be approximately 0 microinches to approximately 50 microinches. For example, in some embodiments, the surface roughness in the first area 120 can be approximately 10 microinches, approximately 20 microinches, approximately 30 microinches, approximately 40 microinches, approximately 50 microinches, approximately 60 microinches, approximately 70 microinches, approximately 80 microinches, approximately 90 microinches, or approximately 100 microinches.

Further referring to FIG. 10A, in the second surface roughness area 124, which extends from the toe 18 to the heel 22, and is positioned between the first and third areas 120, 128, the surface roughness is greater than in the first area 120, but less than the surface roughness in the third area 128. The surface roughness in the second area 124 can be approximately 50 microinches to approximately 120 microinches. For example, in some embodiments, the surface roughness in the second area 124 can be approximately 50 microinches, approximately 60 microinches, approximately 70 microinches, approximately 80 microinches, approximately 90 microinches, approximately 100 microinches, or approximately 120 microinches.

Further referring to FIG. 10A, in the third surface roughness area 128, which is positioned towards the sole 30 side of the center and extends towards the heel 22, the surface roughness is greater than in the first and second areas 120, 124. The surface roughness in the third area 128 can be approximately 100 microinches to approximately 300 microinches. For example, in some embodiments, the surface roughness in the third area 128 can be approximately 100 microinches, approximately 150 microinches, approximately 200 microinches, approximately 250 microinches, or approximately 300 microinches. In other embodiments, the third zone 128 can be positioned towards the sole 30, substantially bisecting the center of club face 38.

Referring to FIG. 10B, in the first surface roughness area 120, which is positioned towards the crown 26 side of the center, substantially bisecting the center of the club face 38, the surface roughness is smoother than the second and third roughness areas 124, 128. The surface roughness in the first area 120 can be approximately 0 microinches to approximately 100 microinches, and more specifically can be approximately 0 microinches to approximately 50 microinches. For example, in some embodiments, the surface roughness in the first area 120 can be approximately 10 microinches, approximately 20 microinches, approximately 30 microinches, approximately 40 microinches, approximately 50 microinches, approximately 60 microinches, approximately 70 microinches, approximately 80 microinches, approximately 90 microinches, or approximately 100 microinches.

In the second surface roughness area 124, which extends from the toe 18 to the heel 22, and is positioned between the first and third areas 120, 128, the surface roughness is greater than in the first area 120, but less than the surface roughness in the third area 128. The surface roughness in the second area 124 can be approximately 50 microinches to approximately 120 microinches. For example, in some embodiments, the surface roughness in the second area 124 can be approximately 50 microinches, approximately 60 microinches, approximately 70 microinches, approximately 80 microinches, approximately 90 microinches, approximately 100 microinches, or approximately 120 microinches.

In the third surface roughness area 128, which is positioned towards the sole 30 side of the center, substantially bisecting the center of the club face 38, the surface roughness is greater than in the first and second areas 120, 124. The surface roughness in the third area 128 can be approximately 100 microinches to approximately 300 microinches. For example, in some embodiments, the surface roughness in the third area 128 can be approximately 100 microinches, approximately 150 microinches, approximately 200 microinches, approximately 250 microinches, or approximately 300 microinches. In other embodiments, the third zone 128 can be positioned towards the sole 30, substantially bisecting the center of club face 38.

It should be appreciated that the surface roughness ranges of the first, second, and third areas 120, 124, 128 are provided for purposes of example, and may be greater than or less than the roughness presented.

The first and third areas 120, 128 are illustrated as having an ellipsoid shape, while the second area 124 has an atypical or irregular shape. In other embodiments, the areas 120, 124, 128 may be any suitable shape, orientation, or combination thereof (e.g., polygonal, circular, irregular, etc.).

The areas 120, 124, 128 can also have any suitable or desired surface area. For example, the first area 120 can be approximately 0 square inches to approximately 3.5 square inches. The third area 128 can be approximately 0 square inches to approximately 3.5 square inches, and more specifically can be approximately 0.5 square inches to approximately 2.5 square inches. The second area 124 can have a surface area that remains (i.e., is not within the first or third areas 120, 128).

Each of the areas 120, 124, 128 has a uniform or the same roughness within the area. In other embodiments, each area 120, 124, 128 can have a plurality of roughness levels within each area.

In the illustrated embodiment, the transition of roughness between each of the areas (e.g., from the first area 120 to the second area 124, and from the second area 124 to the third area 128, etc.) is abrupt. The surface roughness immediately changes when exiting one area 120, 124 and entering the next, respective adjunct area 124, 128. In other embodiments, there can be a transition area between adjacent areas (e.g., from the first area 120 to the second area 124, and from the second area 124 to the third area 128, etc.) where the surface roughness gradually changes between areas (e.g., a slow or gradual change from one area to the next, etc.). The surface roughness can change between areas according to any profile, including, but not limited to, linear, quadratic, parabolic, or any other suitable or desired profile.

While the illustrated embodiment depicts the plurality of surface roughness areas as three different surface roughness areas 120, 124, 128, in other embodiments the plurality of surface roughness areas can include one surface roughness areas, two surface roughness areas or four or more surface roughness areas. In these embodiments, each of the plurality of areas may have any suitable or desired shape, orientation, surface area, and/or roughness.

Referring back to FIG. 10, the club face 38 defines a perimeter or edge 132. The surface roughness areas 120, 124, 128 generally extend inward from the edge 132 of the club face (or towards the center of the club face 38) a distance of more than 0.50 inches. In other embodiments, the surface roughness areas 120, 124, 128 extend inward from the edge 132 of the club face (or towards the center of the club face 38) a distance of no less than 0.50 inches, and more preferably a distance of more than 0.50 inches (including a distance of more than 0.50, 0.55, 0.60, 0.65, 0.70, 0.75, 0.80, 0.85, 0.90, 0.95, and/or 1.00 inches, inclusive of any distance therebetween).

To address the gear effect impact on sidespin (and thus accuracy) and backspin (and thus trajectory and distance), the surface roughness can be varied on the club face 38. For example, the surface roughness on the club face 38 in an area towards the toe 18 and crown 26 can be smoother than the remainder of the club face 38. The smoother roughness decreases the coefficient of friction between the golf ball and that area of the club face 38, and more spin is imparted on the golf ball for golf clubs at or below the loft threshold. This counteracts the lack of spin imparted on the golf ball in this area due to the gear effect.

Similarly, the surface roughness on the club face 38 in an area towards the heel 22 and the sole 30 can be greater than the remainder of the club face 38 (or at least greater surface roughness than the area towards the toe 18 and crown 26). The increased surface roughness increases the coefficient of friction between the golf ball and that area of the club face 38, and less spin is imparted on the golf ball for golf clubs at or below the loft threshold. This also counteracts the additional spin imparted on the golf ball in this area due to the gear effect.

Further, by positioning areas of surface roughness at locations offset from the center of the club face 38 towards the toe 18 and/or the heel 22, sidespin can be influenced. These areas can address the gear effect impact on sidespin (and thus accuracy) by influencing the amount of fade or draw of the golf ball.

In some embodiments, the surface roughness can be formed using a brush to create small stripes or striations on the club face 38. The shape of the visible striations is determined by the direction of the brush stroke on the club face 38. Many current club heads have linear, heel to toe striations formed by a straight brushstroke to impart a constant surface roughness on the club face. In many embodiments described herein, the variable surface roughness can be formed using a rotating brush stroke, thereby forming curved striations to introduce variable surface roughness on the club face 38. In some embodiments, the curved striations can bend upward, or toward the crown of the club head. In some embodiments, the curved striations can bend downward, or toward the sole of the club head.

Figure 11:
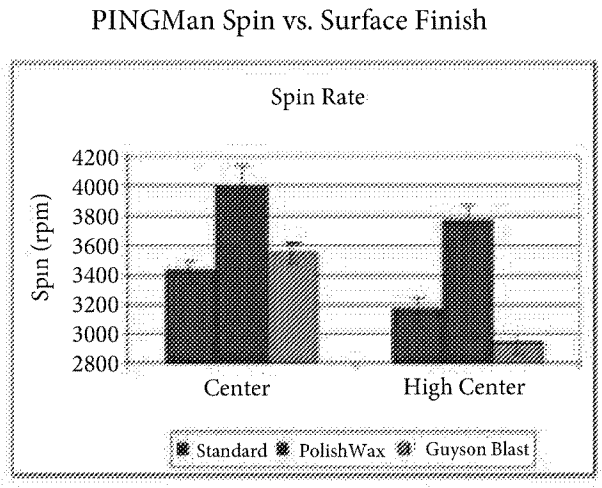
FIG. 11 is a table providing data comparing golf ball spin rate after being struck at different club face impact locations for golf clubs having different levels of surface roughness, the clubs being swung by a golf swing machine.
Figure 12:
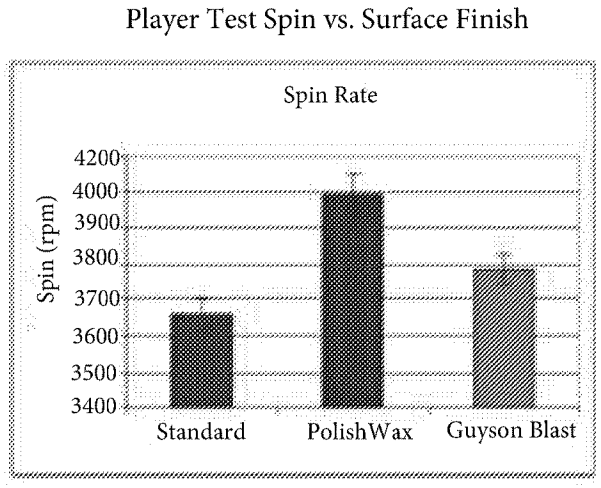
FIG. 12 is a table providing data comparing golf ball spin rate after being struck by clubs having different levels of surface roughness, the clubs being swung by a person.

FIGS. 11-12 provide data that illustrates the effect on spin rate of golf clubs with different surface roughness finishes. More specifically, the data reflects that golf clubs with greater surface roughness that increases the coefficient of friction between the golf ball and club face 38 in golf clubs at or below the loft threshold decreases the spin imparted on the golf ball at impact (i.e. decrease the spin rate after impact) than golf clubs at or below the loft threshold with lower surface roughness.

Referring to FIG. 11, the spin rates of a golf ball struck by golf clubs having differing surface finishes are compared. The golf clubs were struck using a golf swing machine. Each golf club was struck on the center of the club face 38 and the high center of the club face 38 (on the crown 26 side of the center). For a golf club having an intermediate roughness (not smooth, but not rough), which is labeled as "standard," the spin rate is slightly above 3400 RPM on center hits and slightly below 3200 RPM on high center hits. As the roughness decreases, the spin rate of the golf ball increases. For a golf club having a smooth surface roughness, which is labeled as "polish/wax," the spin rate is the highest, and specifically about 4000 RPM on center hits and slightly below 3800 RPM on high center hits. For a golf club having the highest surface roughness, which is labeled as "Guyson Blast," the spin rate is intermediate on center hits or slightly below 3600 RPM, and the lowest on high center hits or below 3000 RPM. As the roughness increases (and coefficient of friction between the club face 38 and the golf ball increases), the spin rate of the golf ball decreases, particularly on off center impact locations (i.e., impact other than the sweet spot).

Referring to FIG. 12, the spin rates of a golf ball struck by golf clubs having differing surface finishes are compared. The golf clubs were struck by a human/player, and impact location on the club face was not controlled. For a golf club having an intermediate roughness (not smooth, but not rough), which is labeled as "standard," the spin rate is approximately 3650 RPM. For a golf club having a smooth surface roughness, which is labeled as "polish/wax," the spin rate is the highest, and specifically about 4000 RPM. For a golf club having the highest surface roughness, which is labeled as "Guyson Blast," the spin rate is intermediate and approximately 3800 RPM.

III. Other Surface Features

In other embodiments of the club head 10, the surface feature 100 can include a combination of microgrooves 104 and surface roughness 116. The microgrooves 104 and surface roughness 116 can be separated into separate zones (or areas) on separate portions of the club face 38 (e.g., a zone of microgrooves 104 on the club face 38 and a zone of surface roughness 116 on the club face, etc.) or can be positioned in the same area or zone of the club face 38.

In some embodiments, the surface feature 100 can reduce backspin on a golf ball on impact with all areas of the club face 38. In some embodiments, the surface feature 100 can reduce backspin on a golf ball on impact with specific portions of the club face 38, such as the bottom or heel portion, to normalize spin for impacts on all areas of the club face 38. For example, in some embodiments, the club head 10 having the surface feature 100 can have a maximum change in backspin of less than 800 RPM, less than 700 RPM, less than 600 RPM, less than 500 RPM, less than 400 RPM, less than 300 RPM, less than 200 RPM, or less than 100 RPM for impact with a golf ball on various positions of the club face 38.

In the illustrated embodiments, the surface feature 100 comprises one or more of microgrooves 104 and surface roughness 116. In other embodiments, the surface feature can include other features, such as a textured surface or a material coating instead of or in addition to the surface features 100 described herein to increase or decrease the coefficient of friction on one or more regions of the club face 38. For example, the surface feature can comprise a material coating having a varying thickness profile or varying hardness profile to reduce or normalize the spin on the club face 38. For further example, the surface feature can comprise a textured pattern (e.g. a snake skin or other pattern) having a varying density to reduce or normalize the spin on the club face 38.

IV. Method of Manufacturing Club Head with Surface Feature

A method of manufacturing a club head 10 having the surface features 100 is provided. The method includes providing the body 14 having the crown 26, the sole 30, the heel toe 18, the heel 22, and the hosel 42. Next the club face 38 is provided, and the club is formed by attaching the club face 38 to the club body 12. The surface features 100 can be added to the club face 38 before or after attachment of the club face 38 to the club body 12.

In embodiments where the surface features 100 are microgrooves 104, the microgrooves 104 can be formed by computer numerical controlled lasers, chemical etching, machining, 3D printing, or any other suitable process.

In embodiments where the surface features 100 are one or more areas or zones of surface roughness 116, the surface roughness 116 can be formed by computer controlled laser etching. Further, the laser etching can include the application of a precise mask followed by a chemical etching process. The laser etching or chemical etching process can create a variation of surface roughness in a relatively random pattern or in a more uniform manner such as by inscribing microgrooves. As an alternative, or in addition, the surface features 100 can be applied using a multi-step finishing process that can include polishing the entire club face 38 to the lowest surface roughness, and progressively masking and roughening additional portions of the club face 38 until the desired number of different roughness areas are formed. Examples of roughing processes that can be employed include brushing, blasting, and/or etching processes. As an alternative, or in addition, the surface features 100 can be applied by adding material by, for example, vapor deposition or spraying.

In embodiments where the surface features 100 are a combination of microgrooves 104 and surface roughness 116, one or more of the formation processes above can be implemented or combined to respectively form the microgrooves 104 and the surface roughness 116.

The method of manufacturing the club head 10 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

Clause 1. A golf club head comprising:

a body having a crown opposite a sole, a toe end opposite a heel end, a back end, and a hosel;

a club face having a loft below a loft threshold in which increasing a coefficient of friction between a golf ball and the club face decreases the spin imparted on the golf ball after impact with the club face; and a surface feature positioned on a portion of the club face configured to increase the coefficient of friction between the golf ball and the club face.

Clause 2. The golf club head of clause 1, wherein the surface feature includes a plurality of microgrooves.

Clause 3. The golf club head of clause 2, wherein each microgroove of the plurality of microgrooves has a groove depth of between 0.001 inches and 0.050 inches.

Clause 4. The golf club head of clause 2, wherein each microgroove of the plurality of microgrooves has a groove width of between 0.001 inches and 0.050 inches.

Clause 5. The golf club head of clause 2, wherein each microgroove of the plurality of microgrooves has one of a box-shape, V-shape, or U-shape cross-sectional shape.

Clause 6. The golf club head of clause 2, wherein the microgrooves have a uniform distance between each adjacent microgroove.

Clause 7. The golf club head of clause 2, wherein the microgrooves have an increasing distance between each adjacent microgroove.

Clause 8. The golf club head of clause 7, wherein the distance between each adjacent microgroove increases by 0.002 inches.

Clause 9. The golf club head of clause 2, wherein the microgrooves have a first zone containing a first plurality of the microgrooves and a second zone containing a second plurality of the microgrooves, and wherein the distance between adjacent microgrooves is less in the first zone than in the second zone.

Clause 10. The golf club head of clause 9, wherein the first zone is positioned closer to the sole than the second zone.

Clause 11. The golf club head of clause 9, wherein the second zone is positioned closer to the crown than the first zone.

Clause 12. The golf club head of clause 1, wherein the surface feature includes a plurality of areas, with each area having a different surface roughness.

Clause 13. The golf club head of clause 12, wherein the plurality of areas includes a first area having a first surface roughness and a second area having a second surface roughness that is greater than the first surface roughness.

Clause 14. The golf club head of clause 12, wherein the first surface roughness is between 0 microinches and 100 microinches, and the second surface roughness is between 100 microinches and 300 microinches.

Clause 15. The golf club head of clause 14, wherein the first surface roughness is between 0 microinches and 50 microinches.

Clause 16. The golf club head of clause 14, wherein the first area is positioned on a crown side of a center of the club face and extends towards the toe and the crown.

Clause 17. The golf club head of clause 16, wherein the second area is positioned on a sole side of the center of the club face and extends towards the heel and the sole.

Clause 18. The golf club head of clause 17, wherein the first and second areas extend from a position on an outer perimeter of the club face inward more than 0.50 inches.

Clause 19. The golf club head of clause 17, wherein the first area has a lower coefficient of friction between the golf ball and the club face than the second area.

Clause 20. The golf club head of clause 17, wherein the second area has a higher coefficient of friction between the golf ball and the club face that the first area.

Clause 21. The golf club head of clause 14, further comprising a third area having a third surface roughness, wherein the third surface roughness is between 50 microinches and 120 microinches.

Clause 22. The golf club head of clause 21, wherein the third area is positioned on the club face between the first and second areas.

Clause 23. The golf club head of clause 1, wherein the loft threshold is between 15 and 25 degrees.

Clause 24. The golf club head of clause 1, wherein the loft threshold is less than 25 degrees.

Clause 25. A golf club having the golf club head of clause 1.

Clause 26. A method of manufacturing the golf club head of clause 1, comprising providing the body having the crown, the sole, the heel, the toe, the back end, and the hosel;

providing the club face;

forming the surface feature on the club face; and forming or coupling the club face to the club body.

Clause 27. A golf club head comprising:

a body having a crown opposite a sole, a toe opposite a heel end, a back, and a hosel;

a club face having a loft below a loft threshold in which increasing a coefficient of friction between a golf ball and the club face decreases the spin imparted on the golf ball after impact with the club face, the club face further including a first zone positioned closer to the sole and closer to the heel than a second zone positioned closer to the crown and closer to the toe; and a surface feature positioned on a portion of the club face configured to increase the coefficient of friction between the golf ball and the club face, wherein:

the coefficient of friction between the portion of the club face having the surface feature and the golf ball is greater than approximately 0.25; and the coefficient of friction between the club face in the first zone and the golf ball is greater than the coefficient of friction between the club face in the second zone and the golf ball.

Clause 28. The golf club head of clause 27, wherein the surface feature includes a plurality of microgrooves.

Clause 29. The golf club head of clause 28, wherein each microgroove of the plurality of microgrooves has a groove depth of between 0.001 inches and 0.050 inches.

Clause 30. The golf club head of clause 28, wherein each microgroove of the plurality of microgrooves has a groove width of between 0.001 inches and 0.050 inches.

Clause 31. The golf club head of clause 28, wherein each microgroove of the plurality of microgrooves has one of a box-shape, V-shape, or U-shape cross-sectional shape.

Clause 32. The golf club head of clause 28, wherein the microgrooves have a uniform distance between each adjacent microgroove.

Clause 33. The golf club head of clause 28, wherein the microgrooves have an increasing distance between each adjacent microgroove in a direction toward the crown.

Clause 34. The golf club head of clause 33, wherein the distance between each adjacent microgroove increases by 0.002 inches in a direction toward the crown.

Clause 35. The golf club head of clause 28, wherein the first zone comprises a first plurality of the microgrooves and the second zone comprises a second plurality of the microgrooves, and wherein the distance between adjacent microgrooves is less in the first zone than in the second zone.

Clause 36. The golf club head of clause 27, wherein the loft threshold is between 15 and 25 degrees.

Clause 37. The golf club head of clause 27, wherein the loft threshold is less than 25 degrees.

Clause 38: A golf club head comprising:

a body having a crown opposite a sole, a toe opposite a heel, a back end, and a hosel;

a club face having a loft below a loft threshold in which increasing a coefficient of friction between a golf ball and the club face decreases the spin imparted on the golf ball after impact with the club face, the club face further having a plurality of areas including a first area, a second area, and a third area, wherein:

the first area is positioned on a crown side of a center of the club face and extends towards the toe and the crown;

the third area is positioned on a sole side of the center of the club face and extends towards the heel and the sole; and the second area is positioned between the first area and the third area; and a surface feature positioned on a portion of the club face configured to increase the coefficient of friction between the golf ball and the club face, wherein:

the coefficient of friction between the portion of the club face having the surface feature and the golf ball is greater than approximately 0.25; and the coefficient of friction between the club face in the first zone and the golf ball is less than the coefficient of friction between the club face in the second zone and the golf ball, and the coefficient of friction between the club face in the second zone and the golf ball is less than the coefficient of friction between the club face in the third zone and the golf ball.

Clause 39. The golf club head of clause 38, wherein the plurality of areas each have a different surface roughness.

Clause 40. The golf club head of clause 39, wherein the first area has a first surface roughness between 0 microinches and 100 microinches, the second area has a second surface roughness between 50 microinches and 120 microinches, and the third area has a third surface roughness between 100 microinches and 300 microinches.

Clause 41. The golf club head of clause 40, wherein the first surface roughness is between 0 microinches and 50 microinches.

Clause 42. The golf club head of clause 38, wherein the first, second, and third areas extend from a position on an outer perimeter of the club face inward more than 0.50 inches.

Clause 43. The golf club head of clause 38, wherein the loft threshold is between 15 and 25 degrees.

Clause 44. The golf club head of clause 38, wherein the loft threshold is less than 25 degrees.

Clause 45. A golf club having the golf club head of clause 27.

Clause 46. A method of manufacturing the golf club head of clause 27, comprising providing the body having the crown, the sole, the heel, the toe, the back end, and the hosel;

providing the club face;

forming the surface feature on the club face; and forming or coupling the club face to the club body.

The invention claimed is:

1. A golf club head comprising:

a body having a crown opposite a sole, a toe opposite a heel, a back end, and a hosel;

a club face having a loft below 25 degrees in which increasing a coefficient of friction between a golf ball and the club face decreases the spin imparted on the golf ball after impact with the club face, the club face further having a plurality of areas including a first area, a second area, and a third area, wherein:

the first area is positioned on a crown side of a center of the club face and extends towards the toe and the crown;

the third area is positioned on a sole side of the center of the club face and extends towards the heel and the sole; and the second area is positioned between the first area and the third area;

the first area, the second area, and the third area, each comprise a plurality of roughness levels within each area;

a surface feature positioned on a portion of the club face configured to increase the coefficient of friction between the golf ball and the club face, the surface feature comprising a plurality of microgrooves, and a surface finish including a surface roughness having deviations in the direction of a vector normal to the club face, wherein:

adjacent microgrooves are separated by a space such that the space between adjacent microgrooves in the third area is less than the space between adjacent microgrooves in the second area, and the space between adjacent microgrooves in the second area is less than the space between adjacent microgrooves in the first area;

the surface roughness varies across the club face such that the coefficient of friction between the club face and the golf ball increases in a direction extending from the toe to the heel, and from the crown to the sole;

the coefficient of friction between the club face and the golf ball in the first area, the second area, and the third area each increase in a direction extending from the toe to the heel, and in a direction extending from the crown to the sole.

2. The golf club head of claim 1, wherein the roughness levels of the first area varies within a range between 0 microinches and 100 microinches.

3. The golf club head of claim 1, wherein the roughness levels of the second area varies within a range between 50 microinches and 120 microinches.

4. The golf club head of claim 1, wherein the roughness levels of the third area varies within a range between 100 microinches and 300 microinches.

5. The golf club head of claim 1, wherein the roughness levels of the first, second, and third area do not overlap.

6. The golf club head of claim 1, wherein the surface roughness immediately changes when exiting one area and entering the next, respective adjunct area.

7. The golf club head of claim 1, each of the plurality of roughness levels between the club face in the first area and the golf ball is less than each of the plurality of roughness levels between the club face in the second area and the golf ball, and each of the plurality of roughness levels between the club face in the second area and the golf ball is less than each of the plurality of roughness levels between the club face in the third area and the golf ball.

8. The golf club head of claim 1, wherein the coefficient of friction between the portion of the club face having the surface feature and the golf ball is greater than approximately 0.25.

9. A golf club head comprising:

a body having a crown opposite a sole, a toe opposite a heel, a back end, and a hosel;

a club face having a loft below 25 degrees in which increasing a coefficient of friction between a golf ball and the club face decreases the spin imparted on the golf ball after impact with the club face, the club face further having a plurality of areas including a first area, a second area, and a third area, wherein:

the first area is positioned on a crown side of a center of the club face and extends towards the toe and the crown, the first area comprises a plurality of surface roughness levels;

the third area is positioned on a sole side of the center of the club face and extends towards the heel and the sole, the third area comprises a plurality of surface roughness levels;

the second area is positioned between the first area and the third area, the second area comprises a plurality of surface roughness levels;

wherein the surface roughness levels in the third area, are greater than the surface roughness levels in the second area, and the surface roughness levels in the second area are greater than the surface roughness levels in the first area;

a surface feature positioned on a portion of the club face configured to increase the coefficient of friction between the golf ball and the club face, the surface feature comprising a plurality of microgrooves, and a surface finish including a surface roughness having deviations in the direction of a vector normal to the club face, wherein:

adjacent microgrooves are separated by a space such that the space between adjacent microgrooves in the third area is less than the space between adjacent microgrooves in the second area, and the space between adjacent microgrooves in the second area is less than the space between adjacent microgrooves in the first area:

the coefficient of friction between the club face and the golf ball in the first area, the second area, and third area each increase in a direction extending from the toe to the heel, and in a direction extending from the crown to the sole.

10. The golf club head of claim 9, wherein the roughness levels of the first area varies within a range between 0 microinches and 100 microinches.

11. The golf club head of claim 9, wherein the roughness levels of the second area varies within a range between 50 microinches and 120 microinches.

12. The golf club head of claim 9, wherein the roughness levels of the third area varies within a range between 100 microinches and 300 microinches.

13. The golf club head of claim 9, wherein the roughness levels of the first, second, and third area do not overlap.

14. The golf club head of claim 9, wherein the surface roughness immediately changes when exiting one area and entering the next, respective adjunct area.

15. The golf club head of claim 9, each of the plurality of roughness levels between the club face in the first area and the golf ball is less than each of the plurality of roughness levels between the club face in the second area and the golf ball, and each of the plurality of roughness levels between the club face in the second area and the golf ball is less than each of the plurality of roughness levels between the club face in the third area and the golf ball.

16. The golf club head of claim 9, wherein the coefficient of friction between the portion of the club face having the surface feature and the golf ball is greater than approximately 0.25.

* * * * *